US005808225A

United States Patent [19]

Corwin et al.

[11] Patent Number: 5,808,225

[45] Date of Patent: Sep. 15, 1998

[54] COMPRESSING MUSIC INTO A DIGITAL FORMAT

[75] Inventors: Susan J. Corwin, Portland, Oreg.; David J. Kaplan, Santa Clara, Calif.; Thomas D. Fletcher, Portland, Oreg.

[73] Assignee: Intel Corporation, Santa Clara, Calif.

[21] Appl. No.: 777,250

[22] Filed: Dec. 31, 1996

[51] Int. Cl.[6] ..... G10H 7/00

[52] U.S. Cl. ..... 84/622; 84/602; 84/603; 84/604; 84/616

[58] Field of Search ..... 84/602–606, 615, 84/616, 622, 653–654, 659

*Primary Examiner*—William M. Shoop, Jr.
*Assistant Examiner*—Marlon T. Fletcher
*Attorney, Agent, or Firm*—Blakely, Sokoloff, Taylor & Zafman

[57] ABSTRACT

A method for compressing music into a digital format. An audio signal that corresponds to music is received and converted from an analog signal to a digital signal. The audio signal is analyzed, and a tone is identified. The musical note and instrument that correspond to the tone are determined, and data elements that represent the musical note and instrument are then stored.

20 Claims, 4 Drawing Sheets

| INSTRUMENT | NOTE | AMPLI-TUDE | TIME | BRIGHT-NESS | TIME | BRIGHT-NESS | TIME | BRIGHT-NESS |
|---|---|---|---|---|---|---|---|---|
| • • • | • • • | • • • | • • • | • • • | • • • | • • • | • • • | • • • |
| PIANO | C4 | 50 | 0.000 | 0.0 | 0.001 | 0.4 | 0.002 | 3.2 |
| PIANO | C4 | 150 | 0.000 | 0.0 | 0.001 | 1.2 | 0.002 | 5.3 |
| PIANO | C6 | 50 | 0.000 | 0.0 | 0.001 | 0.2 | 0.002 | 1.3 |
| PIANO | C6 | 150 | 0.000 | 0.0 | 0.001 | 0.3 | 0.002 | 1.7 |
| CLARINET | C2 | 50 | 0.000 | 0.0 | 0.004 | 0.2 | 0.008 | 0.4 |
| CLARINET | C2 | 150 | 0.000 | 0.0 | 0.004 | 0.8 | 0.008 | 1.2 |
| • • • | • • • | • • • | • • • | • • • | • • • | • • • | • • • | • • • |

FIG. 6

COMPRESSING MUSIC INTO A DIGITAL FORMAT

FIELD OF THE INVENTION

The present invention relates to signal compression and more particularly to a method for compressing an audio music signal into a digital format.

BACKGROUND OF THE INVENTION

Signal compression is the translating of a signal from a first form to a second form wherein the second form is typically more compact (either in terms of data storage volume or transmission bandwidth) and easier to handle. The second form is then used as a convenient representation of the first form. For example, suppose the water temperature of a lake is logged into a notebook every 5 minutes over the course of a year. This may generate thousands of pages of raw data. After the information is collected, however, a summary report is produced that contains the average water temperature calculated for each month. This summary report contains only twelve lines of data, one average temperature for each of the twelve months.

The summary report is a compressed version of the thousands of pages of raw data because the summary report can be used as a convenient representation of the raw data. The summary report has the advantage of occupying very little space (i.e. it has a small data storage volume) and can be transmitted from a source, such as a person, to a destination, such as a computer database, very quickly (i.e. it has a small transmission bandwidth).

Sound, too, can be compressed. An analog audio music signal comprises continuous waveforms that are constantly changing. The signal is compressed into a digital format by a process known as sampling. Sampling a music signal involves measuring the amplitude of the analog waveform at discrete intervals in time, and assigning a digital (binary) value to the measured amplitude. This is called analog to digital conversion.

If the time intervals are sufficiently short, and the binary values provide for sufficient resolution, the audio signal can be successfully represented by a finite series of these binary values. There is no need to measure the amplitude of the analog waveform at every instant in time. One need only sample the analog audio signal at certain discrete intervals. In this manner, the continuous analog audio signal is compressed into a digital format that can then be manipulated and played back by an electronic device such as a computer or a compact disk (CD) player. In addition, audio signals can be further compressed, once in the digital format, to further reduce the data storage volume and transmission bandwidth to allow, for example, CD-quality audio signals to be quickly transmitted along phone lines and across the internet.

SUMMARY OF THE INVENTION

A method for compressing music into a digital format is described. A tone is identified in an audio signal that corresponds to music. The musical note and instrument that correspond to the tone are determined, and data elements that represent the musical note and instrument are then stored.

Other features and advantages of the present invention will be apparent from the accompanying drawings and the detailed description that follows.

BRIEF DESCRIPTION OF THE DRAWINGS

The present invention is illustrated by way of example and not limitation in the figures of the accompanying drawings in which like references indicate similar elements and in which:

FIG. 6 is a portion of a database in accordance with an embodiment of the present invention.

DETAILED DESCRIPTION

A method for compressing music into a digital format is described in which an analog audio signal comprising musical tones is received. The signal undergoes analog to digital conversion by sampling the analog audio signal at a high rate to convert the signal into a high resolution digital signal. This digital signal is then divided into a series of small frames containing pieces of the digital signal that are approximately synchronous.

For each frame, the musical notes and loudness (amplitude) of each tone is determined. The notes are then compared between frames to match up notes that are played across multiple frames. In this manner, the frames corresponding to the time at which a note is played and the note stops playing, and all frames in-between, are identified to determine the timing and timbre (frequency spectrum over time) of each of the notes. After determining the timbre of each note, the timbre is compared to a set of known timbres of musical instruments to determine the musical instrument that most closely matches the timbre of each of the notes.

Data elements representing the notes of the audio signal, the instruments upon which each of the notes are played, and the loudness of each note are then stored. The addresses of each of these data elements are indexed by a sequencer that records the proper timing (e.g. duration, order, pauses, etc.) of the notes. In this manner, the analog audio music signal is highly compressed into a very low bandwidth signal in a digital format such as, for example, the musical instrument digital interface (MIDI) format. Music compressed in this manner can be readily transmitted across, for example, even low-bandwidth phone lines and other networks, and can be easily stored on relatively low capacity storage devices such as, for example, floppy disks.

If desired, the audio signal can be reconverted back into an analog signal output that approximates the original analog audio signal input by playing, according to the sequence information, each of the notes at their corresponding amplitudes on synthesized musical instruments.

By compressing music into this convenient digital format, the music can be modified in unique ways by, for example, transposing the music into a different key, adjusting the tempo, changing a particular instrument, or re-scoring the musical notation. This music compression method is described in more detail below to provide a more thorough description of how to implement an embodiment of the present invention. Various other configurations and implementations in accordance with alternate embodiments of the present invention are also described in more detail below.

Figure 1:
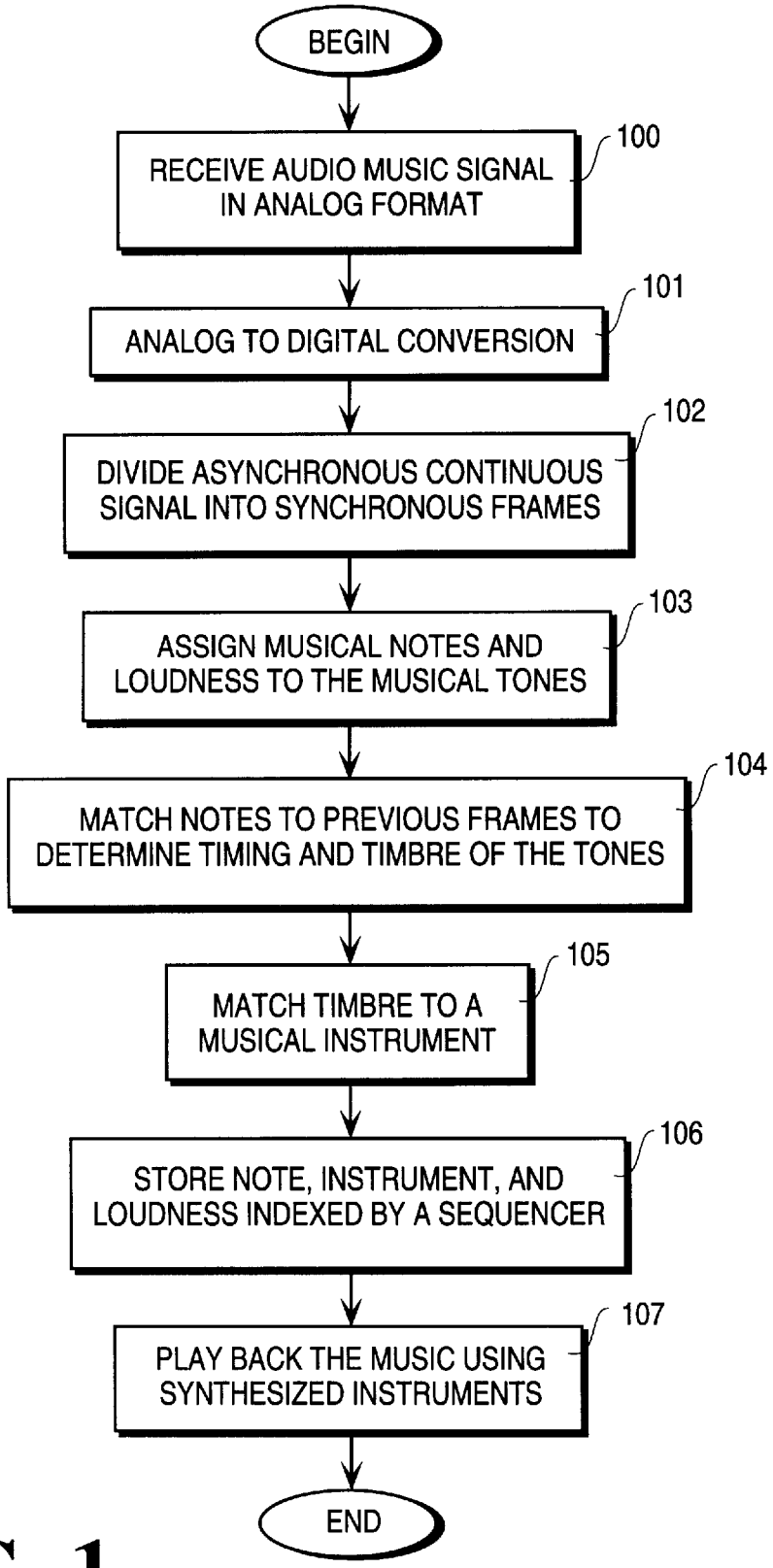
FIG. 1 is a flow of a method of one embodiment of the present invention.

FIG. 1 is a flow chart of a method of one embodiment of the present invention. At step 100 an audio music signal is received by an electronic device or multiple devices such as, for example, a computer or a dedicated consumer electronic component. The audio signal is generated by, for example, a CD player, the output of which is coupled to the input of the electronic device. Alternatively, the analog audio signal may be generated by the live performance of one or more musical instruments, converted into analog electrical impulses by a microphone, the output of which is coupled to the input of the electronic device. The music signal comprises a series of musical tones.

At step 101 of FIG. 1, the analog signal is converted into a digital signal. In accordance with one embodiment of the present invention, this conversion is done by an analog to digital converter that has a sample rate of at least 40 KHz with 20-bit resolution. By converting the analog signal in this manner, the full audio frequency bandwidth of 20—20 KHz can be accurately captured with a high signal to noise ratio. Accurate representation of the full frequency spectrum may be particularly advantageous during steps 103–105, as discussed below.

For an alternate embodiment of the present invention, a lower sample rate or bit resolution is implemented. For example, a sample rate of as low as 20 KHz with 8-bit resolution may be implemented in an effort to lower the memory capacity required to implement the compression method of the present invention. The accuracy of determining the musical notes and instruments may, however, suffer at lower sample rates and bit resolution. For an alternate embodiment of the present invention in which a digital audio signal is coupled directly to the electronic device that implements the method of the present invention, steps 100 and 101 of FIG. 1 are skipped entirely.

At step 102 of FIG. 1, the digital audio signal stream from step 101 is divided into a series of frames, each frame comprising a number of digital samples from the digital signal. Because the entire audio signal is asynchronous (i.e. its waveform changes over time) it is difficult to analyze. This is partially due to the fact that much of the frequency analysis described herein is best done in the frequency domain, and transforming a signal from the time domain to the frequency domain (by, for example, a Fourier transform or discrete cosine transform algorithm) is most ideally done, and in some cases can only be done, on synchronous signals. Therefore, the width of the frames is selected such that the portion of the audio signal represented by the digital samples in each frame is approximately symmetrical (approximately constant over the period of time covered by the frame). In accordance with one embodiment of the present invention, depending on the type of music being compressed, the frame width may be made wider (longer in time) or narrower (shorter in time). For complex musical scores having faster tempos, narrower frames should be used.

At step 103 of FIG. 1, a frame from step 102 is analyzed to determine the musical notes (notes of, e.g., an equal tempered scale), and the loudness of each of the notes. The notes and loudness can be determined by any of a number of methods, many of which involve analyzing the frequency spectrum for amplitude (loudness) peaks that indicate the presence of a note, and determining the fundamental frequency that corresponds to the peaks. Note that in accordance with the nomenclature used herein, the term "note" is intended to indicate either the actual name of a particular note, or, when sound qualities are attributed to the term "note," the term is to be interpreted as the tone corresponding to the note when played.

Figure 2:
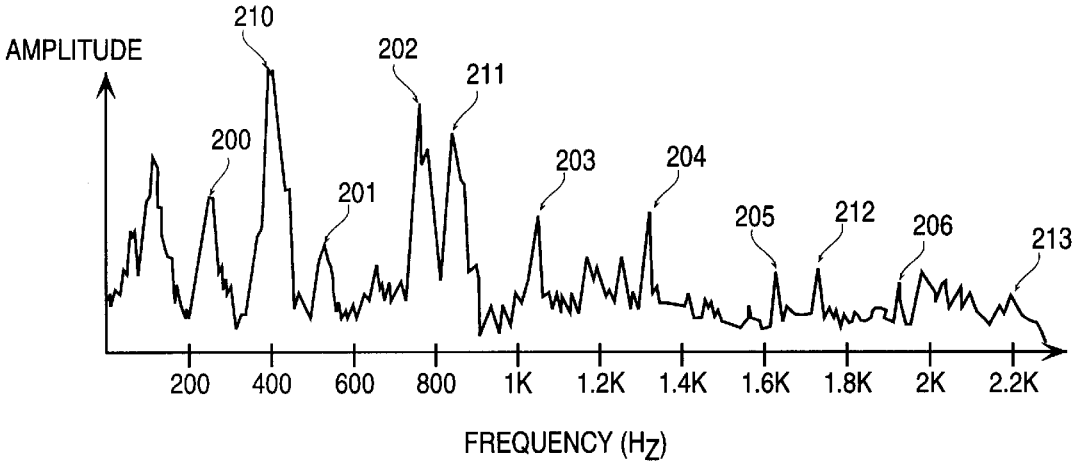
FIG. 2 is a graph of amplitude versus frequency for an audio signal.

FIG. 2 is a graph of amplitude versus frequency for an audio signal frame. Note that the amplitude scale of FIG. 2, and all other figures, is arbitrary and may correspond to decibels, intensity, voltage levels, amperage, or any other value proportional to the amplitude of the audio signal. In accordance with one embodiment of the present invention, the amplitude scale is selected to adequately distinguish differences in amplitude between the frequency components of the signal's frequency spectrum.

As shown in FIG. 2, the frequency spectrum includes many local maxima. For an embodiment of the present invention in which the audio music signal includes multiple instruments having complex timbres playing simultaneously, groups of local maxima correspond to the harmonics of a single fundamental frequency. For one embodiment of the present invention, determining the set of fundamental frequencies that are present in a particular frequency spectrum of a frame involves a mathematical analysis of the identified local maxima of the spectrum.

For example, according to the frequency spectrum of FIG. 2, a local maximum is found at point 200, corresponding to approximately 260 Hz. Local maxima are also found at points 201, 202, 203, 204, 205, and 206 corresponding to approximately 520 Hz, 780 Hz, 1040 Hz, 1300 Hz, 1560 Hz, and 1820 Hz, respectively. A local maximum is also found at point 210, corresponding to approximately 440 Hz. Local maxima are also found at points 211, 212, and 213 corresponding to approximately 880 Hz, 1760 Hz, and 2200 Hz, respectively. Points 200–206 can be grouped together as a fundamental frequency, f(0), of 260 Hz at point 200, plus its harmonics (overtones) at 2f(0), 3f(0), 4f(0), 5f(0), 6f(0) and 7f(0), referred to as f(1), f(2), f(3), f(4), f(5), and f(6), respectively (or first harmonic, second harmonic, third harmonic, etc.). Similarly, points 210–213, and 204 can be grouped together as a fundamental frequency, f(0), of 440 Hz at point 210, plus its first four upper harmonics at points 211, 204, 212, and 213.

Thus, according to the frequency spectrum of FIG. 2, at least two tones, one at approximately 260 Hz and one at approximately 440 Hz, are identified in the frame. There may be other tones in the frame, and the local maxima are further analyzed by identifying a maximum and checking for corresponding frequency harmonics to determine if groupings of other frequencies might be present that point to a fundamental frequency.

To assign musical notes to the identified tones, in accordance with step 103 of FIG. 1, the fundamental frequencies are used in a mathematical algorithm to determine the corresponding notes. For example, the fundamental frequency of 260 Hz identified in FIG. 2 corresponds to a note in an equal-tempered scale whose octave is given by int $[\mathrm{Log}_2(260/16.35)]=4$, and whose note within the fourth octave is given by $12\times\mathrm{frac}[\mathrm{Log}_2(260/16.35)]=0$. Thus, the 260 Hz tone is note C4. Similarly, the fundamental frequency of 440 Hz identified in FIG. 2 corresponds to a note whose octave is given by $\mathrm{int}[\mathrm{Log}_2(440/16.35)]=4$, and whose note within the fourth octave is given by $12\times\mathrm{frac}[\mathrm{Log}_2(440/16.35)]=12$. Thus, the 440 Hz tone is note A4 (12 half-steps up from C4). Note that 16.35 Hz is used as the base frequency in these equations because it corresponds to the first note of the first scale, CO.

For an alternate embodiment of the present invention, a scale other than the equal tempered scale, such as, for example, the just scale, is used to determine the musical notes corresponding to the identified tones. In accordance with one embodiment of the present invention in which a tone is calculated to be between notes, the deviation from the nearest note (in, for example, cents) is calculated and stored.

This stored value may be used as, for example, pitch bend data during playback of the music.

Also, for one embodiment of the present invention, once all the fundamental frequencies have been identified, remaining frequencies of the frequency spectrum that do not correspond to harmonics of any identified fundamental frequencies are analyzed for inharmonic (asynchronous) tones. Inharmonic tones tend to be related to percussive instruments such as, for example, drums, and cymbals. These remaining frequencies may be grouped into frequency ranges to identify, for example, the striking of a bass drum in the lower frequency range, tom tom drums in the low to mid frequency range, a snare drum in the mid frequency range, and cymbals in the upper frequency range.

In accordance with one embodiment of the present invention, to assign loudness to the identified tones, in accordance with step 103 of FIG. 1, the overall amplitude of the tone is calculated by any of a number of methods including, for example, adding the amplitude values of the fundamental frequency plus each of its upper harmonics. For an alternate embodiment, a more complex algorithm is used to determine the overall amplitude of the tone, taking into account, for example, psycho-acoustic principles of the perception of loudness as it relates to frequency.

At step 104 of FIG. 1, the identified notes are grouped with the same notes identified in previously analyzed, contiguous frames, and the timing and timbre of the tones corresponding to the notes are analyzed. For one embodiment of the present invention, timing refers to the identification, calculation, and storage of information related to when a particular note is played, when the note is released (i.e. the duration of the note), and the overall sequence of the notes in time. By comparing contiguous frames to each other, it can be determined whether or not an identified note in a particular frame is likely to be real, and if real, whether the note in one frame is a continuation of the note from a previous frame or is a new note.

For example, for one embodiment of the present invention, a note that is identified only in a single frame, but not in adjacent frames of the audio signal, is discarded as being a false identification of a tone. For another embodiment, a note that is identified in a first and third frame, but not in the contiguous middle frame, is determined to be a false non-identification of a tone, and the note is added to the middle frame (extrapolating the frequency spectrum from the first to the third frames). Frames are searched backward in time to identify the frame (and, hence, the corresponding time) containing the initial sounding of a particular note (note-on), and are searched forward in time to identify the frame (and corresponding time) containing the release of the particular note (note-off). In this manner, timing of the note is determined, and this information is stored.

Figure 3:
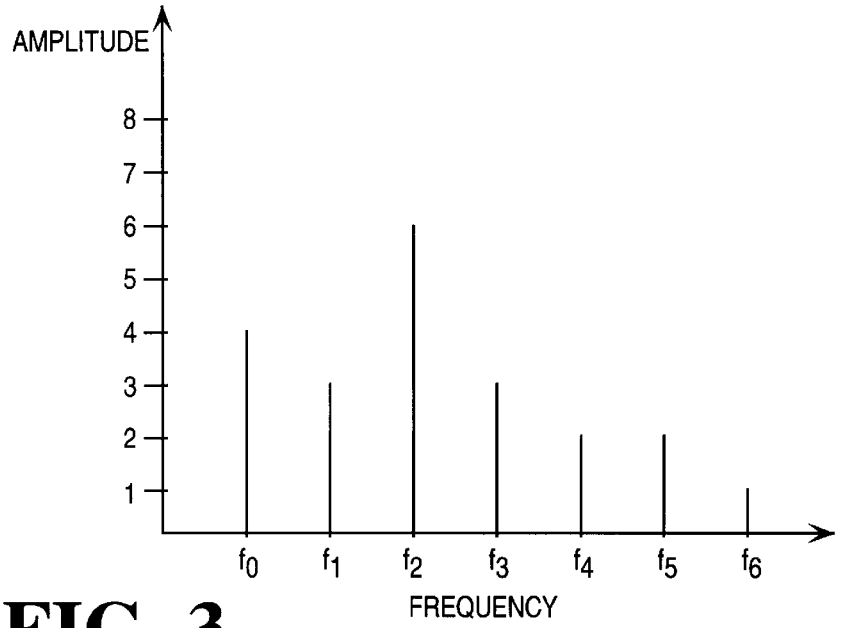
FIG. 3 is a graph of amplitude versus frequency for the harmonics of a tone from the audio signal in accordance with an embodiment of the present invention.

In addition, in accordance with step 104 of FIG. 1, the timbre of the tones corresponding to the notes is analyzed. As an example, FIG. 3 is a graph of amplitude versus frequency for harmonics f(1), f(2), f(3), f(4), f(5), and f(6) and fundamental frequency f(0) of the tone at 260 Hz, corresponding to note C4, identified in the frequency spectrum of FIG. 2. Fundamental frequency f(0) of FIG. 3 corresponds to peak 200 of FIG. 2, and first harmonic f(1) of FIG. 3 corresponds to peak 201 of FIG. 2. By comparing contiguous frames to one another, as described above, it is determined that note C4 is struck (note-on) 3 ms before the occurrence of the frame of FIGS. 2 and 3. Therefore, the frequency spectrum of note C4 at time t=3 ms (as measure from note-on) is characterized by the graph of FIG. 3.

Note that the fourth harmonic f(4) of note C4 overlies the second harmonic f(2) of note A4 at peak 204 of FIG. 2. This harmonic, at approximately 1300 Hz, corresponds to f(4) of FIG. 3. In accordance with one embodiment of the present invention, the amplitude of harmonic f(4) of C4 is determined by estimating how much of the total amplitude of peak 204 is attributable to C4 (versus A4) using cues including, for example, the overall amplitude of note C4 versus A4, the harmonic number of the peak for C4 versus A4, and the difference between the C4 note-on occurrence and the A4 note-on occurrence.

Figure 4:
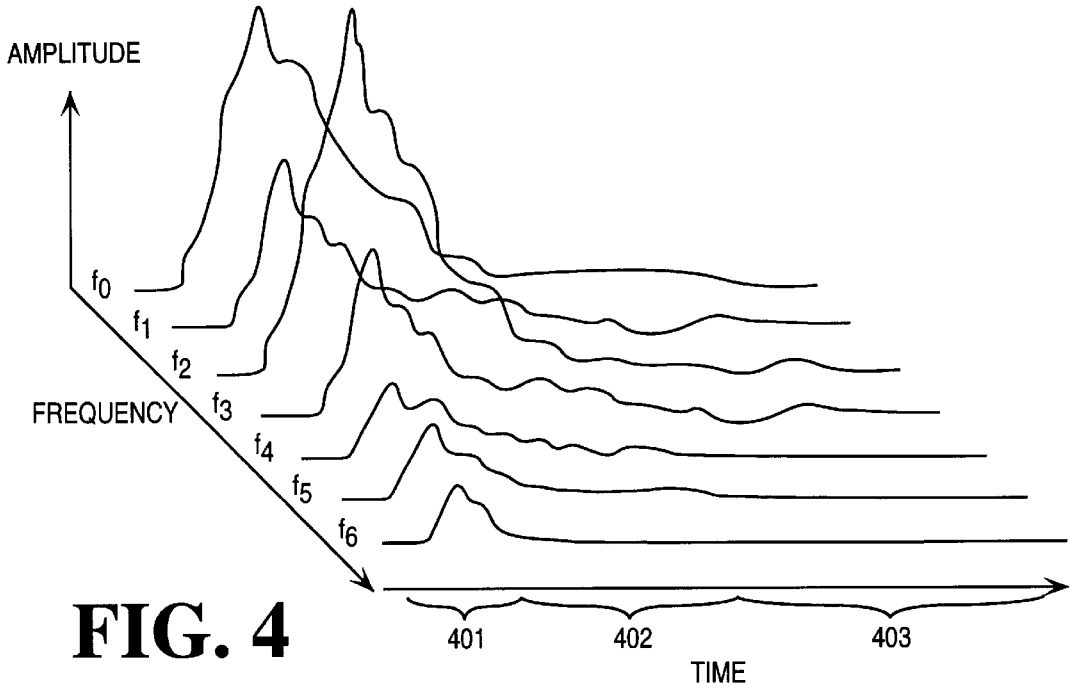
FIG. 4 is a graph of amplitude versus frequency versus time for the harmonics of the tone in accordance with an embodiment of the present invention.

FIG. 4 is a graph of amplitude versus frequency versus time for the harmonics of the C4 tone of FIG. 3. To put FIG. 4 into perspective in relation to FIG. 3, FIG. 3 is the cross-section through the harmonics of FIG. 4 at time t=3 ms after note-on. FIG. 4 shows the frequency spectrum (timbre) of the fundamental and first six harmonics of the tone associated with note C4 identified in the frame of FIG. 2, combined with all other contiguous frames in which note C4 was identified, from note-on to note-off.

Figure 5:
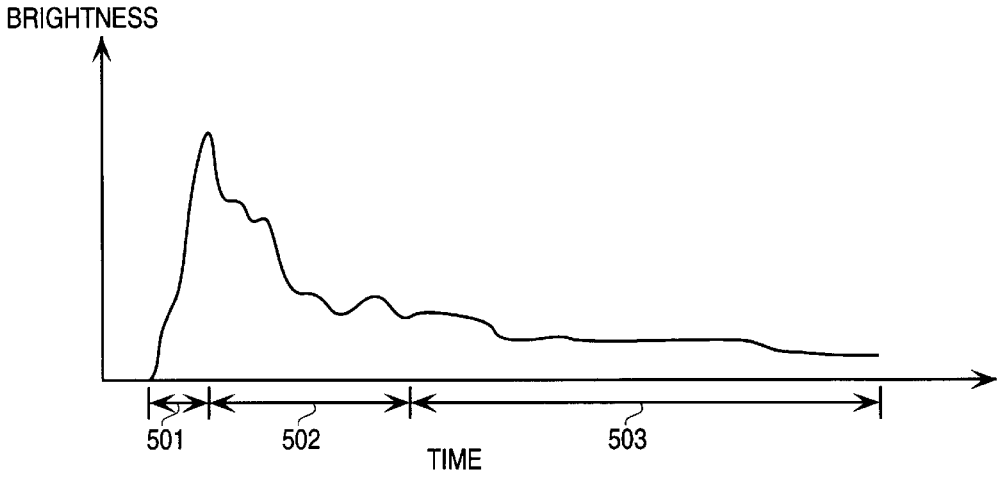
FIG. 5 is a graph of brightness versus time for the tone in accordance with an embodiment of the present invention.

FIG. 5 is a graph of brightness versus time for the tone of FIG. 4, in accordance with an embodiment of the present invention. Brightness is a factor that can be calculated in any of a number of different ways. A brightness factor indicates a tone's timbre by representing the tone's harmonics as a single value for each time frame. A brightness parameter set, or brightness curve, that represents the frequency spectrum of the tone is generated by grouping together the brightness factors of a tone across multiple frames. For one embodiment of the present invention, a brightness factor is generated by determining the amplitude-weighted average of the harmonics of a tone, including the fundamental frequency. For example, for the C4 note at time t=3 ms shown in FIG. 3, the brightness factor is calculated as $[(4\times f(0))+(3\times f(1))+(6\times f(2))+(3\times f(3))+(2\times f(4))+(2\times f(5))+(1\times f(6))](4+3+6+3+2+2+1)=[(4\times f(O))+(3\times 2f(0))+(6\times 3f(0)) +(3\times 4f(O))+(2\times 5f(0))+(2\times 6f(0))+(1\times 7f(0))]/21=f(0)(4+6+18+12+10+12+7)/21=f(0)\ (69/21)=3.3f(0)$. So the brightness factor is 3.3 at t=3 ms.

For alternate embodiments of the present invention, brightness is calculated by determining the amplitude-weighted RMS value of the harmonics, the amplitude-weighted median of the harmonics, or the amplitude-weighted sum of the harmonics, including the fundamental frequency.

In accordance with step 105 of FIG. 1, the timbre identified at step 104 is matched to the timbre of a musical instrument that most nearly approximates the timbre identified at step 104 for the tones of the identified notes. For one embodiment of the present invention, a database is maintained that contains timbre information for many different instruments, and the identified timbre of a particular note is compared to the timbres stored in the database to determine the musical instrument corresponding to the note. This is done for all identified notes.

FIG. 6 is a portion of a database in which a brightness parameter set for different musical instruments is contained. In accordance with one embodiment of the present invention, several brightness parameter sets containing brightness factors calculated at various time frames is stored for each instrument, each parameter set having been calculated for different notes played at different amplitudes on the instrument. In accordance with an alternate embodiment of the present invention, other parameter sets that represent the frequency spectrum of the musical instruments are stored. For example, for one embodiment a brightness factor is not calculated at step 104 of FIG. 1. Instead, the timbre of a tone is compared directly to timbre entries in the database by comparing the amplitudes of each harmonic of an identified tone to the amplitudes of harmonics stored in the database as the parameter set.

In accordance with one embodiment of the present invention, the parameter set represented by the brightness curve of FIG. 5, is compared to the brightness parameter set corresponding to note C4 (having a similar amplitude) of the piano tone in the database of FIG. 6. The C4 brightness curve is then compared to the data elements of the brightness parameter set of note C4 (or the nearest note thereto) of other instruments in the database of FIG. 6, and the instrument corresponding to the brightness values that most closely approximate the brightness curve of FIG. 5 is identified.

At step 106 of FIG. 1, the identified note (e.g. C4 of the above example), instrument (as identified by matching instrument timbres to the note timbre), and loudness level (as identified by measuring amplitudes of the frequency components of the identified note) are stored in memory. Timing information is also stored in a sequencer that keeps track of the addresses within which the note, instrument, and loudness information is stored, so that these addresses can be accessed at the appropriate times during playback of the music signal.

For example, for one embodiment of the present invention, the note, instrument, and loudness data is stored in MIDI code format. The note is stored as a single data element comprising a data byte containing a pitch value between 0 and 127. The instrument data is stored as a single data element comprising a patch number data byte wherein the patch number is known to be associated with a patch on an electronic synthesizer that synthesizes the desired instrument. The loudness data is stored as a single data element comprising a velocity data byte wherein the velocity corresponds to the desired loudness level. For an alternate embodiment of the present invention, an alternate music code format is used that is capable of storing note information, musical instrument information, and loudness information as data elements, wherein each data element may comprise any number of bytes of data.

At step 107 of FIG. 1, a sequencer plays back the music using synthesized instruments. In accordance with one embodiment of the present invention, the playback is modified by modifying the stored data elements such that the music is transposed into a different key, the tempo is modified, an instrument is changed, notes are changed, instruments are added, or the loudness is modified.

In the foregoing specification, the invention has been described with reference to specific exemplary embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. A method for compressing music into a digital format, the method comprising the computer-implemented steps of:

a. determining an approximate musical note corresponding to a tone identified in the music by analyzing a frequency spectrum of the music;

b. determining an approximate musical instrument corresponding to the tone by comparing a representation of a frequency spectrum of the tone to a representation of a frequency spectrum of the musical instrument; and c. storing a first data element representing the musical note and a second data element representing the musical instrument.

2. The method of claim 1, further comprising the steps of determining an approximate amplitude corresponding to the tone by analyzing the frequency spectrum of the music, and storing a third data element representing the amplitude.

3. The method of claim 1, further comprising the steps of determining an approximate duration of the tone by analyzing a plurality of frequency spectrums of the music to determine an approximate time difference between note-on and note-off of the musical note, and storing information representing the duration.

4. The method of claim 1, further comprising the step of playing back the musical tone on an electronic device that uses the first data element to determine the musical note that is to be played and the second data element to determine the musical instrument to synthesize for the note.

5. The method of claim 4, wherein the first and second data elements correspond to a musical instrument digital interface (MIDI) code format, and the MIDI code is modified by changing the musical note and changing the musical instrument before playing back the tone.

6. The method of claim 1, wherein the step of determining an approximate musical instrument corresponding to the tone comprises the steps of determining a parameter set that corresponds to an approximate frequency spectrum of the tone over a period of time, and matching the parameter set to a musical instrument corresponding to a similar parameter set stored in a database.

7. The method of claim 6, wherein the database comprises a plurality of parameter sets corresponding to a plurality of frequency spectrums of a plurality of musical instruments played at a plurality of different amplitudes on a plurality of different notes.

8. The method of claim 1, wherein the first and second data elements correspond to a musical instrument digital interface (MIDI) code format.

9. A method for compressing an audio signal comprising the computer-implemented steps of:

analyzing a frequency spectrum of a first portion of the audio signal to identify a set of amplitude peaks corresponding to a tone;

calculating a musical note corresponding to the tone;

comparing a timbre of the tone to a plurality of timbres stored in a database to identify a musical instrument corresponding to the timbre of the tone; and storing a first data element representing the musical note and a second data element representing the musical instrument.

10. The method of claim 9, further comprising the step of converting the audio signal from an analog signal to a digital signal before the step of analyzing the frequency spectrum.

11. The method of claim 9, further comprising the steps of calculating an amplitude corresponding to the tone as a function of the set of amplitude peaks, and storing a third data element representing the amplitude.

12. The method of claim 9, further comprising the step of analyzing frequency spectrums of a plurality of contiguous portions of the audio signal, before and after the first portion of the audio signal, to determine the timing of the musical note.

13. The method of claim 9, further comprising the step of analyzing frequency spectrums of a plurality of contiguous portions of the audio signal, before and after the first portion of the audio signal, to determine if the musical note is real.

14. The method of claim 9, further comprising the steps of calculating a deviation of the tone from the musical note and storing this deviation as pitch bend data.

15. The method of claim 9, wherein the step of analyzing includes the step of discerning the set of amplitude peaks corresponding to harmonics of the tone from other sets of amplitude peaks corresponding to harmonics of other tones.

16. The method of claim 15, wherein the step of calculating includes the step of measuring the difference in frequency between two amplitude peaks of the set of amplitude peaks corresponding to the harmonics of the tone to calculate a fundamental frequency of the tone.

17. A storage medium having stored thereon a set of instructions that, when executed by a computer system, causes the computer system to perform the steps of:

analyzing a frequency spectrum of a plurality of frames of an audio signal to identify a plurality of harmonics of a tone;

calculating a musical note corresponding to the harmonics;

comparing a representation of the harmonics to a plurality of representations of harmonics stored in a database to identify a musical instrument corresponding to the harmonics of the tone; and storing a first data element representing the musical note and a second data element representing the musical instrument.

18. The storage medium of claim 17, wherein the set of instructions further causes the computer system to perform the steps of calculating an amplitude of the tone and storing a third data element representing the amplitude.

19. The storage medium of claim 17, wherein the set of instructions further causes the computer system to perform the steps of calculating a duration of the tone, and storing information representing the duration.

20. The storage medium of claim 17, wherein the step of comparing a representation of the harmonics to a plurality of representations of harmonics stored in a database includes the step of calculating a brightness curve for the tone and selecting the musical instrument that has a brightness curve that most closely matches the brightness curve of the tone.

* * * * *